US011959211B2

(12) United States Patent
Matsubara et al.

(10) Patent No.: US 11,959,211 B2
(45) Date of Patent: Apr. 16, 2024

(54) EMBROIDERY FRAME ATTACHMENT/DETACHMENT DEVICE AND EMBROIDERY SEWING MACHINE PROVIDED WITH SAME

(71) Applicant: JANOME Corporation, Hachioji (JP)

(72) Inventors: Shotaro Matsubara, Hachioji (JP); Takeshi Oie, Hachioji (JP)

(73) Assignee: JANOME CORPORATION, Hachioji (JP)

( * ) Notice: Subject to any disclaimer, the term of this patent is extended or adjusted under 35 U.S.C. 154(b) by 71 days.

(21) Appl. No.: 17/891,286

(22) Filed: Aug. 19, 2022

(65) Prior Publication Data

US 2023/0063217 A1 Mar. 2, 2023

(30) Foreign Application Priority Data

Aug. 31, 2021 (JP) ..... 2021-141995

(51) Int. Cl.

| | |
|---|---|
| ***D05B 3/24*** | (2006.01) |
| ***D05B 19/00*** | (2006.01) |
| ***D05B 39/00*** | (2006.01) |
| ***D05C 7/00*** | (2006.01) |
| ***D05C 9/06*** | (2006.01) |

(52) U.S. Cl.

CPC ..... *D05B 3/243* (2013.01); *D05B 19/00* (2013.01); *D05B 39/00* (2013.01); *D05C 7/00* (2013.01); *D05C 9/06* (2013.01)

(58) Field of Classification Search

CPC ..... D05B 3/24; D05B 3/243; D05B 19/00; D05B 19/16; D05B 39/00; D05C 7/00; D05C 9/06; D05C 9/02; D05C 9/04

See application file for complete search history.

(56) References Cited

U.S. PATENT DOCUMENTS 5,353,725 A * 10/1994 Sakakibara ..... D05C 9/04 112/470.14
6,457,428 B1 * 10/2002 Vickroy ..... D05C 9/04 112/103
8,327,782 B2 * 12/2012 Tseng ..... D05C 9/06 112/103
9,476,150 B2 * 10/2016 Kawaguchi ..... D05B 19/16

(Continued)

FOREIGN PATENT DOCUMENTS

JP 2017-169877 A 9/2017

*Primary Examiner* — Ismael Izaguirre

(74) *Attorney, Agent, or Firm* — MCGINN I.P. LAW GROUP, PLLC

(57) ABSTRACT

An embroidery frame driving device includes: a base plate firmly fixed to an X-Y driving unit of the embroidery frame driving device; a fixation arm provided on the base plate; an attachment/detachment cam; a removing link; a coupling link; and an embroidery frame. The embroidery frame is slid against the base plate to rotate the attachment/detachment cam and the fixation arm through pressing of a pressing part of a fixation part to press and fix one end of the fixation arm to a fixation groove of the fixation part in attachment of the embroidery frame. The removing link is operated to rotate the coupling link and the attachment/detachment cam to rotate the fixation arm and release pressing and fixation of the fixation groove of the fixation part by the one end of the fixation arm in detachment of the embroidery frame.

8 Claims, 10 Drawing Sheets

(56) References Cited

U.S. PATENT DOCUMENTS

| | | | | |
|---|---|---|---|---|
| 10,954,616 | B2 * | 3/2021 | Kato | D05B 39/00 |
| 2018/0371662 | A1 * | 12/2018 | Fujihara | D05B 39/00 |
| 2020/0291560 | A1 * | 9/2020 | Ueda | D05C 9/04 |

* cited by examiner

Fig. 1A
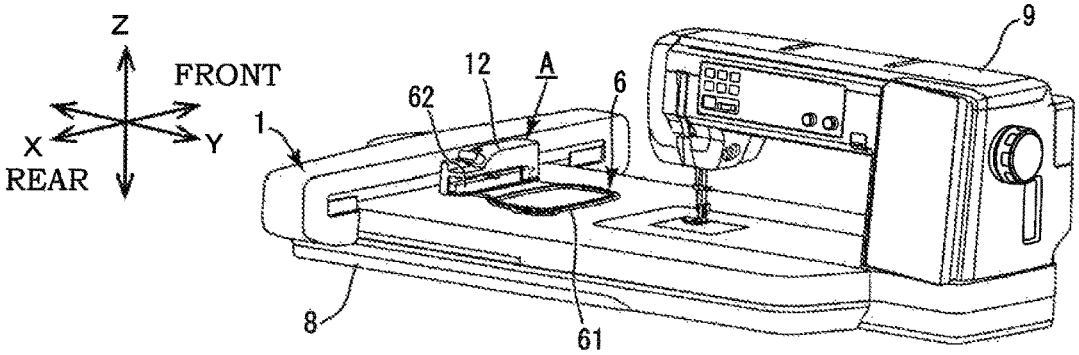
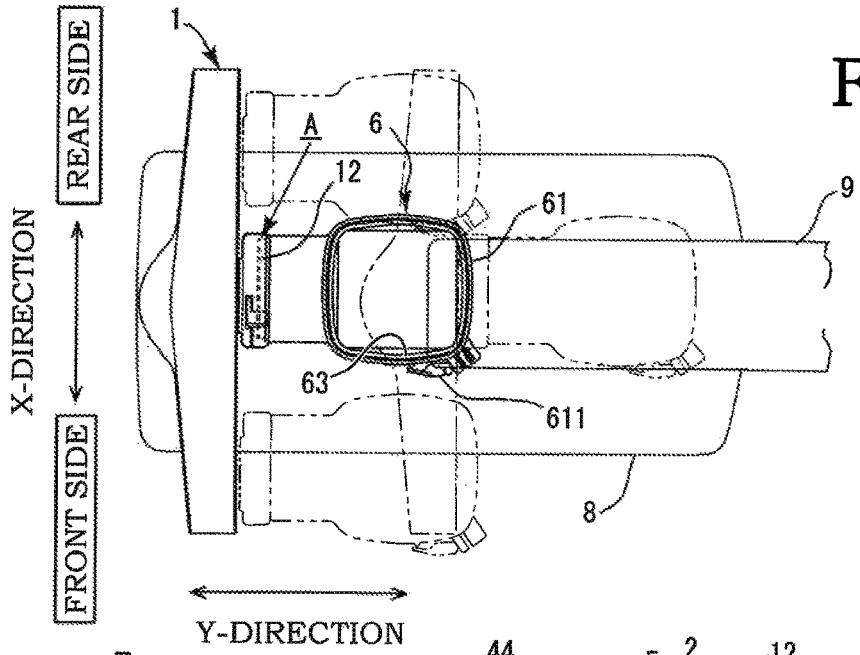
Fig. 1B
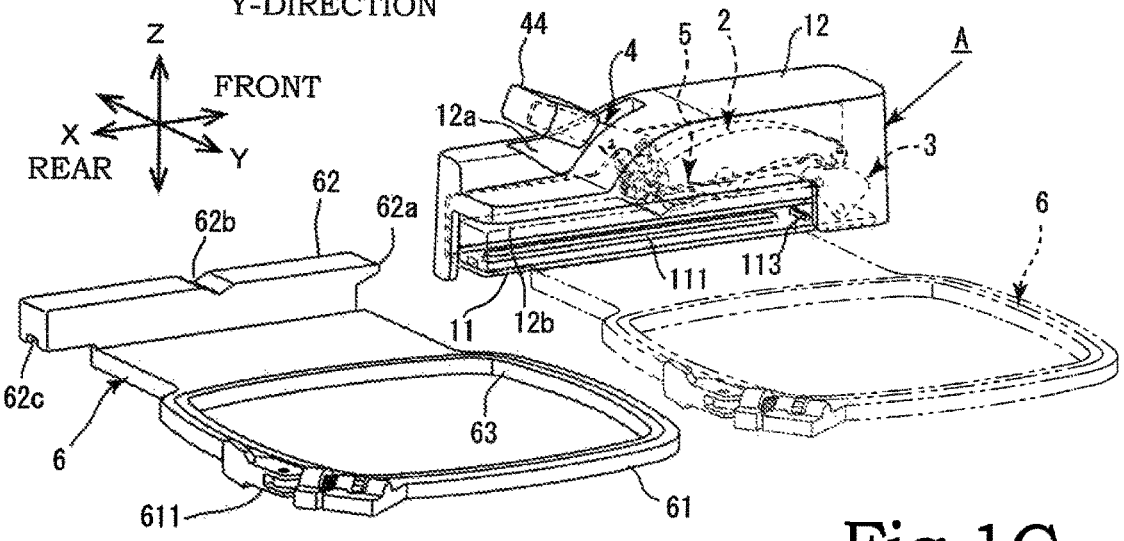
Fig. 1C

MIDDLE STATE 1 IN ATTACHMENT OF EMBROIDERY FRAME

MIDDLE STATE 2 IN ATTACHMENT OF EMBROIDERY FRAME

COMPLETION OF ATTACHMENT OF EMBROIDERY FRAME

ATTACHMENT STEP
(LINK MECHANISM VIEW)

FIG.5A IS SAME AS FIG.7D

MIDDLE STATE 1 IN ATTACHMENT OF EMBROIDERY FRAME

MIDDLE STATE 2 IN ATTACHMENT OF EMBROIDERY FRAME

COMPLETION OF ATTACHMENT OF EMBROIDERY FRAME

DETACHMENT STEP

START DETACHMENT

MIDDLE STATE 1 IN DETACHMENT OF EMBROIDERY FRAME

MIDDLE STATE 2 IN DETACHMENT OF EMBROIDERY FRAME

COMPLETION OF DETACHMENT OF EMBROIDERY FRAME

FIG.6D IS SAME AS FIG.4A

DETACHMENT STEP
(LINK MECHANISM VIEW)

START DETACHMENT

MIDDLE STATE 1 IN DETACHMENT
OF EMBROIDERY FRAME

MIDDLE STATE 2 IN DETACHMENT
OF EMBROIDERY FRAME

COMPLETION OF DETACHMENT
OF EMBROIDERY FRAME

FIG.7D IS SAME AS FIG.5A

Fig.8A
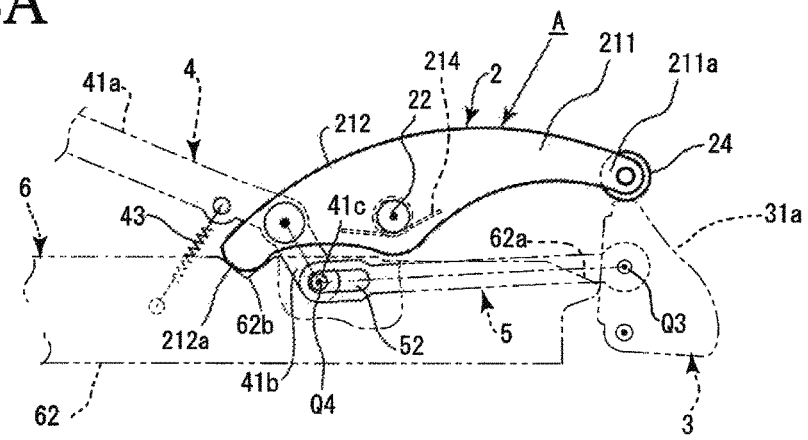
Fig.8B
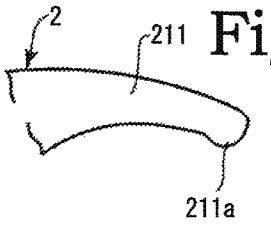
Fig.8C
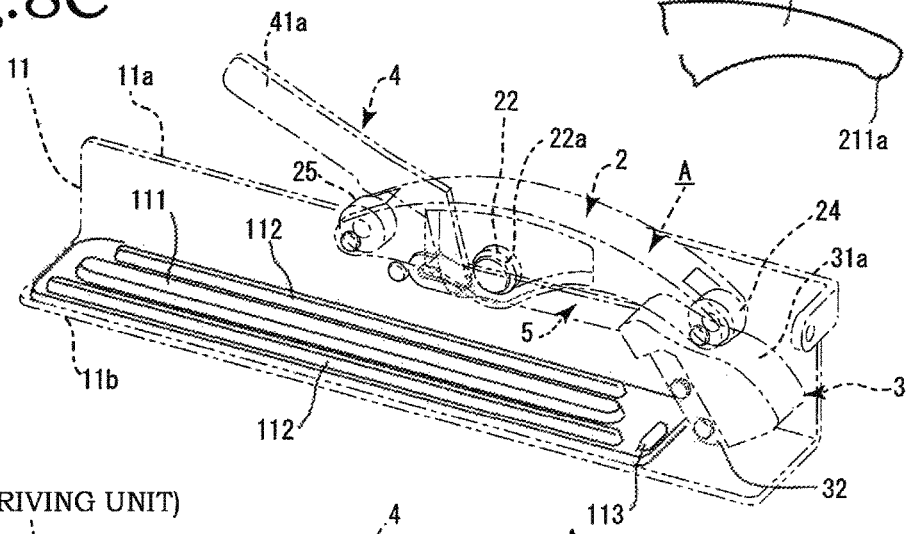
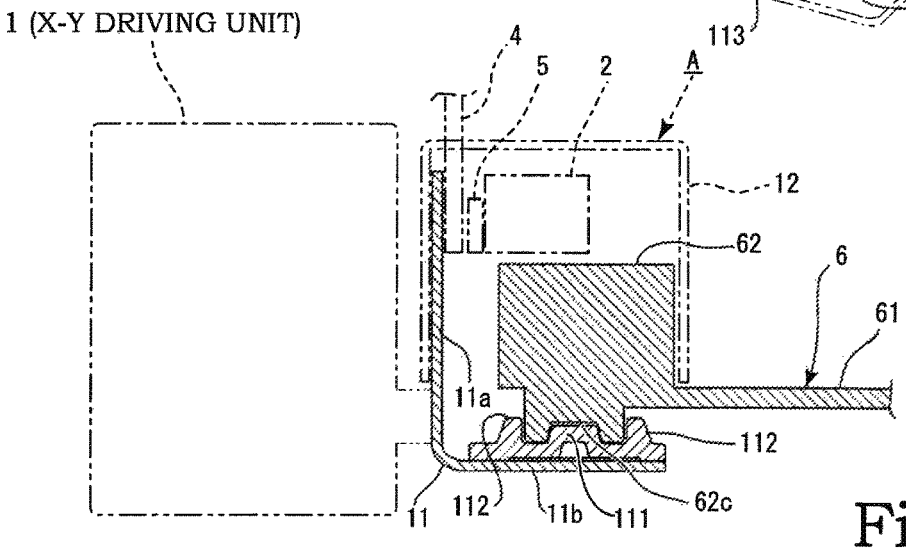
Fig.8D

EMBROIDERY FRAME ATTACHMENT/DETACHMENT DEVICE AND EMBROIDERY SEWING MACHINE PROVIDED WITH SAME

BACKGROUND OF THE INVENTION

1. Field of the Invention

The present invention relates to an embroidery frame attachment/detachment device in a sewing machine with an automatic embroidery function using an embroidery frame and an embroidery sewing machine provided with the same.

2. Description of the Related Art

A known sewing machine is provided with an embroidery driving device able to perform the driving control of an embroidery frame in an X-Y direction to allow automatic embroidery sewing. The sewing machine fixes a sewing object (cloth) with the embroidery frame and performs the driving control of the embroidery frame in the X-Y direction in conjunction with the sewing operation of the sewing machine to allow the cloth to be covered with embroidery.

Meanwhile, the embroidery frame includes an inner frame, an outer frame, and a fixation part and fixes (stretches) cloth so as to be held by the inner frame and the outer frame. In order to improve operability in stretching cloth, the embroidery frame is detachable from the embroidery frame driving device, and various proposals have been made for an attachment/detachment mechanism, particularly an attachment/detachment mechanism that achieves both operability and retention performance.

For example, Japanese Patent Application Laid-open No. 2017-169877 proposes an attachment/detachment mechanism that includes an engaging mechanism 70 and a release member 60 for an embroidery frame, and the engaging mechanism has a hook shape using a spring. When the embroidery frame is slid and pressed into an embroidery frame driving device (carriage), the embroidery frame is fixed and an attachment operation is completed.

SUMMARY OF THE INVENTION

In a related art like Japanese Patent Application Laid-open No. 2017-169877, a spring is used to fix an embroidery frame. Therefore, a spring force has to be increased to improve the fixation force of the embroidery frame. However, an increase in the spring force requires a larger operating force, which in turn reduces operability (causes a trade-off relation). That is, it is difficult to achieve both the fixation force and the operability.

In consideration of the above related art and the problem residing in the related art, present invention has an object of providing: an embroidery frame attachment/detachment device in an embroidery sewing machine, the embroidery frame attachment/detachment device achieving both an improvement in the mutual fixation force between an embroidery frame and embroidery frame driving device and an improvement in operability in attachment/detachment; and an embroidery sewing machine provided with the same.

Accordingly, the present inventor has intensively studied in order to solve the above problem and provides, as a first embodiment of the present invention, an embroidery frame driving device to and from which an embroidery frame is attachable and detachable, the embroidery frame driving device including: a base plate that is firmly fixed to an X-Y driving unit of the embroidery frame driving device; a fixation arm that is pivotally supported by a shaft provided in the base plate; a substantially triangular attachment/detachment cam that is pivotally supported by the base plate; a removing link that is pivotally supported by the base plate; and a coupling link that couples one end of the removing link and a cam partial piece portion of the attachment/detachment cam to each other, wherein the embroidery frame includes a fixation groove that is pressed and fixed by one end of the fixation arm and a fixation part having a pressing part formed at a tip thereof, the embroidery frame is slid against the base plate to rotate the attachment/detachment cam through pressing of the pressing part of the fixation part to rotate the fixation arm via the other end of the fixation arm and press and fix the one end of the fixation arm to the fixation groove of the fixation part in attachment of the embroidery frame, and the removing link is operated to rotate the attachment/detachment cam via the coupling link and the cam partial piece portion to rotate the fixation arm and release pressing and fixation of the fixation groove of the fixation part by the one end of the fixation arm in detachment of the embroidery frame. In order to solve the above problem, a second embodiment of the present invention provides the embroidery frame attachment/detachment device described in the first embodiment, wherein the fixation arm includes a fixation roller that presses and fixes the fixation groove at one end thereof and a cam roller that contacts the attachment/detachment cam at the other end thereof.

In order to solve the above problem, a third embodiment of the present invention provides the embroidery frame attachment/detachment device described in the second embodiment, wherein the fixation roller elastically presses and fixes the fixation groove of the fixation part. In order to solve the above problem, a fourth embodiment of the present invention provides the embroidery frame attachment/detachment device described in the second or third embodiment, wherein a shaft part of at least one of the fixation roller and the cam roller is elastically pressed and supported downward by an urging member while being pivotally supported by a vertically small long hole.

In order to solve the above problem, a fifth embodiment of the present invention provides the embroidery frame attachment/detachment device described in the first or second embodiment, wherein the fixation arm further includes a cam-side arm, a fixation-side arm, and an elastic member that connects the cam-side arm and the fixation-side arm to each other, and the cam-side arm and the fixation-side arm are pivotally supported by the shaft.

In order to solve the above problem, a sixth embodiment of the present invention provides the embroidery frame attachment/detachment device described in the first or second embodiment, wherein a link end on the one end side of the removing link is slidably supported by a long hole formed at an end of the coupling link.

In order to solve the above problem, a seventh embodiment of the present invention provides the embroidery frame attachment/detachment device described in the first or second embodiment, wherein a recessed rail part formed on the fixation part of the embroidery frame is slidable on a protruding rail part provided on a flat part surface of the base plate.

In order to solve the above problem, an eighth embodiment of the present invention provides an embroidery sewing machine including the embroidery frame attachment/detachment device described in the first or second embodiment.

In the present invention, an embroidery frame is slid against a base plate to rotate an attachment/detachment cam through pressing of a pressing part of a fixation part of the embroidery frame to rotate a fixation arm via the other end of the fixation arm and press and fix one end of the fixation arm to a fixation groove of the fixation part in attachment of the embroidery frame. Further, a removing link is operated to rotate the attachment/detachment cam via a coupling link and a cam partial piece portion of the attachment/detachment cam to rotate the fixation arm and release pressing and fixation of the fixation groove of the fixation part by the one end of the fixation arm in detachment of the embroidery frame. With this configuration, each of the fixation arm, the attachment/detachment cam, and the coupling link serves as a substantially link shape.

For that purpose, the embroidery frame attachment/detachment device of the present invention does not constitute its entire main retention mechanism with a spring mechanism but serves as a pseudo substantially quadric link mechanism. Therefore, in the embroidery frame attachment/detachment device, it is possible to feed the embroidery frame into the base plate with a light operating force and make a retention force for the fixation part of the embroidery frame extremely large. Further, it is possible to provide the embroidery frame attachment/detachment device that achieves both operability and a bonding force in the attachment operation of attaching the embroidery frame to the base plate.

BRIEF DESCRIPTION OF THE DRAWINGS

FIG. 1A is a perspective view of a sewing machine including an embroidery frame attachment/detachment device according to the present invention;

FIG. 1B is a plan view of an essential part in FIG. 1A;

FIG. 1C is an enlarged perspective view showing the configuration of the essential part in FIG. 1A;

FIG. 8A is a front view of the fixation arm showing a second embodiment of the present invention;

FIG. 8B is a front view of the essential part of the fixation arm showing a modified example of the second embodiment of the present invention;

FIG. 8C is a perspective view of the essential part of another embodiment of a protruding rail part of a base plate;

FIG. 8D is a vertically cross-sectional lateral view of an essential part in a state in which a recessed rail part of the fixation part of the embroidery frame engages another embodiment of the protruding rail part of the base plate;

DESCRIPTION OF THE PREFERRED EMBODIMENTS

Figure 2A:
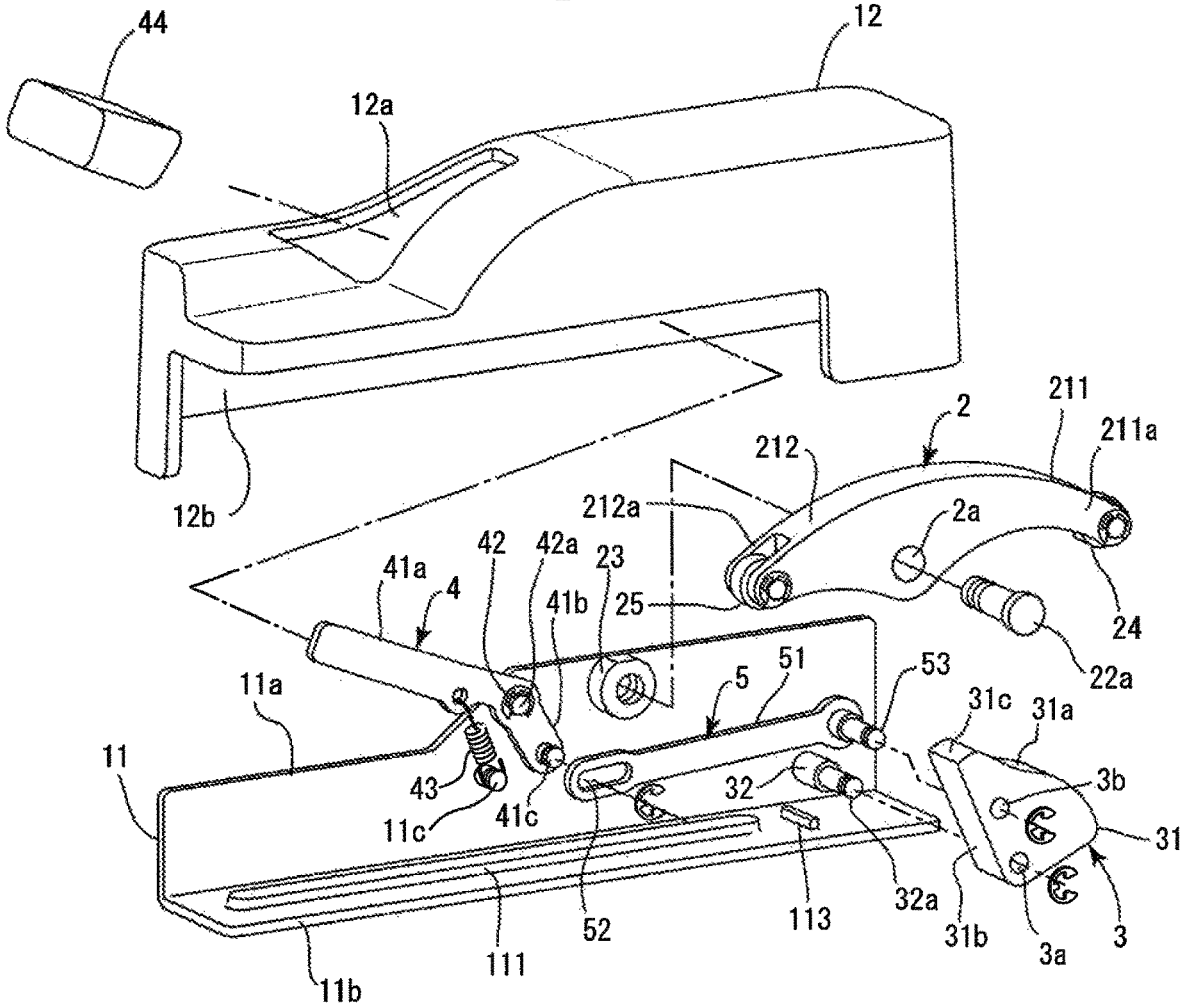
FIG. 2A is an exploded perspective view of the essential part of the embroidery frame attachment/detachment device.
Figure 2B:
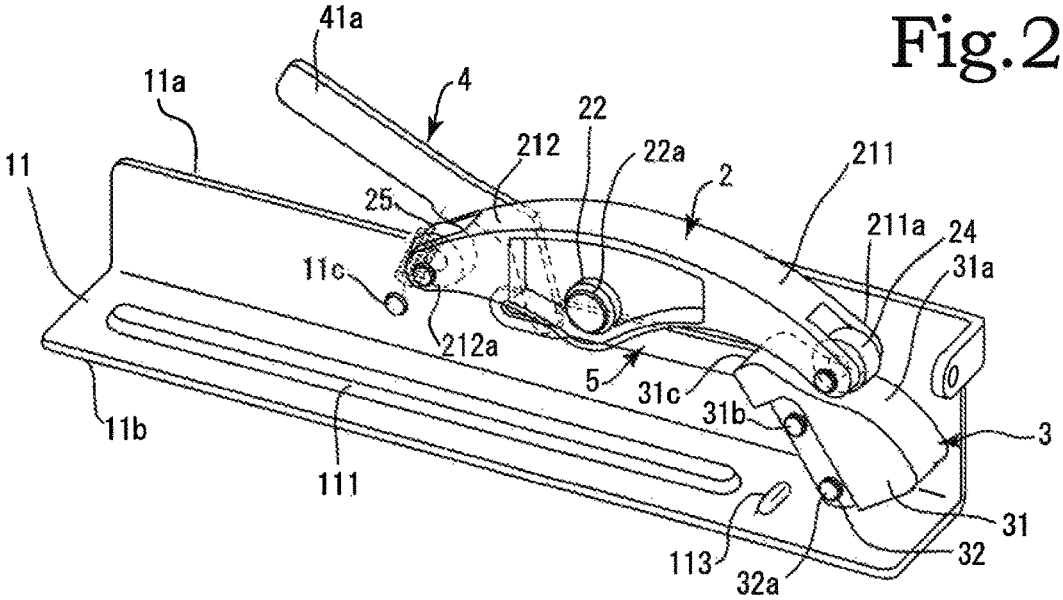
FIG. 2B is a perspective view of the assembly of the essential part of the embroidery frame attachment/detachment device.

Hereinafter, embodiments of the present invention will be described on the basis of the drawings. A device according to the present invention mainly includes an embroidery frame driving device 8 and a sewing machine body 9 (see FIGS. 1A and 1B). In the present invention, there are a plurality of embodiments. A description will be given in order from a first embodiment. The embroidery frame driving device 8 is installed so as to be substantially integrated with the body bed of the sewing machine body 9 (see FIG. 1A). Further, there is also an embodiment in which the embroidery frame driving device 8 is attachably/detachably installed in the sewing machine body 9. The embroidery frame driving device 8 includes an X-Y driving unit 1 (see FIGS. 1A to 1C).

In the attachment/detachment between a base plate 11 installed in the X-Y driving unit 1 and a fixation part 62 of the embroidery frame 6 in the embroidery frame driving device 8 of an embroidery frame attachment/detachment device A according to the present invention, it is possible to put the embroidery frame 6 into an attached (locked) state with respect to the base plate 11 only by sliding and pressing the embroidery frame 6 into the base plate 11 and possible to release the attached (locked) state and remove the embroidery frame 6 from the base plate 11 only by operating an operating lever part 41*a* of a removing link 4 (see FIGS. 4A to 7D or the like) as will be described later.

In the present invention, X, Y, and Z directions are defined for convenience of explanation. In the embroidery frame attachment/detachment device A, a direction in which the fixation part 62 of the embroidery frame 6 is attached to and detached from the base plate 11 of the X-Y driving unit 1 is defined as the X-direction. As for the X-direction, a start side and a completion side in the attachment of the fixation part 62 of the embroidery frame 6 to the base plate 11 are defined as a rear side and a front side, respectively.

The embroidery frame attachment/detachment device A is provided in the X-Y driving unit 1 provided in the embroidery frame driving device 8 (see FIGS. 1A and 1B). The embroidery frame attachment/detachment device A includes the base plate 11, a fixation arm 2, an attachment/detachment cam 3, the removing link, a coupling link 5, and the embroidery frame 6 (see FIGS. 1A to 2B).

The X-Y driving unit 1 is installed in the embroidery frame driving device 8. A Y-direction driving mechanism (not shown) is installed in the embroidery frame driving device 8 and allows the X-Y driving unit 1 to reciprocate in the Y-direction. Inside the X-Y driving unit 1, an X-direction driving mechanism (not shown) that reciprocates the embroidery frame attachment/detachment device A in the X-direction is provided. The base plate 11 is coupled to the X-direction driving mechanism (not shown) inside the X-Y driving unit 1 (see FIG. 8D). Note that known mechanisms may be used as the X-direction driving mechanism and the Y-direction driving mechanism.

The base plate 11 of the embroidery frame attachment/detachment device A is coupled to the X-Y driving unit 1 by a fixation tool such as a screw. The base plate 11 includes a perpendicular base part 11*a* and a rail base part 11*b*. The perpendicular base part 11*a* and the rail base part 11*b* form a right angle (including a substantially right angle). The fixation arm 2, the attachment/detachment cam 3, and the removing link 4 are rotatably attached to the perpendicular base part 11*a* (see FIGS. 2A, 2B, 3A and 3B).

The rail base part 11*b* is a flat part surface serving as a flat surface, and a protruding rail part 111 is provided along the X-direction on the flat part surface. Further, there is also an embodiment in which auxiliary rails 112 and 112 are provided on both sides of the protruding rail part 111 in parallel with the protruding rail part 111 (FIGS. 8C and 8D). The embroidery frame 6 is allowed to obtain an excellent sliding state by the auxiliary rails 112 and 112, besides the protruding rail part 111.

The details of the fixation arm 2 will be described later. The attachment/detachment cam 3 has a substantially triangular shape. The attachment/detachment cam 3 has a cam partial piece portion 31 constituting a cam outer periphery. The cam partial piece portion 31 is a generic name of respective surfaces constituting the attachment/detachment cam 3 and includes a cam front surface 31*a*, a cam rear surface 31*b*, a cam top surface 31*c*, and both lateral surfaces.

Figure 4A:
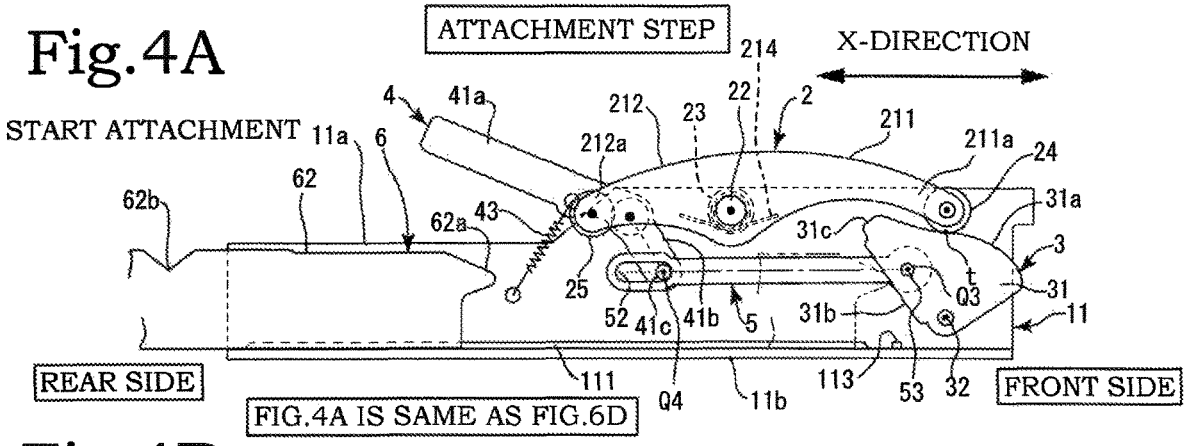
FIGS. 4A to 4D are partially-cut essential-part step views showing a step from the start of attaching an embroidery frame to the completion of attaching the embroidery frame of the embroidery frame attachment/detachment device in the present invention.
Figure 4B:
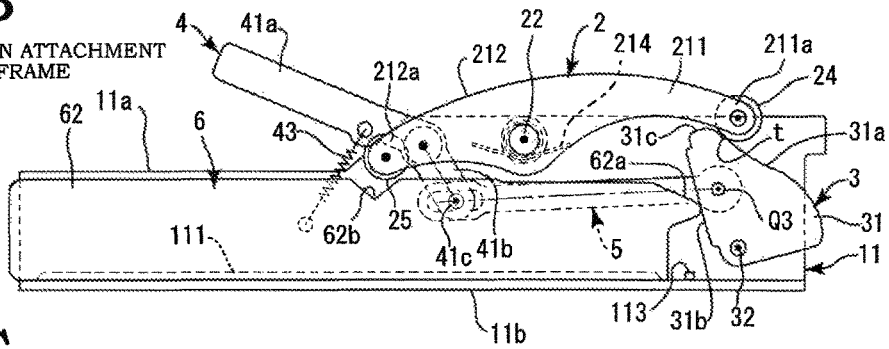
Figure 4C:
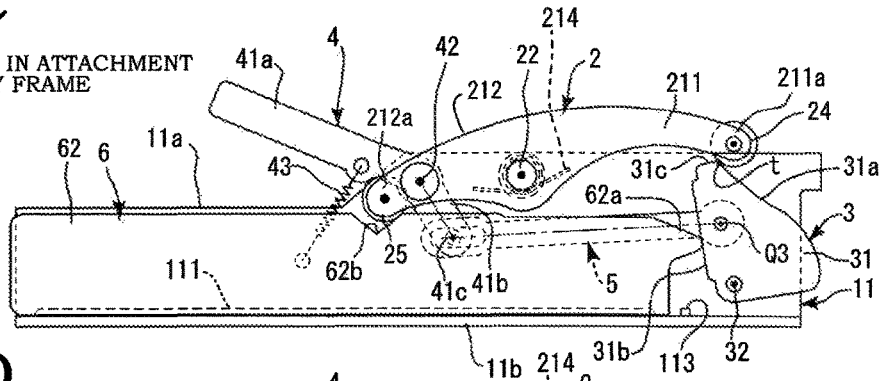
Figure 4D:
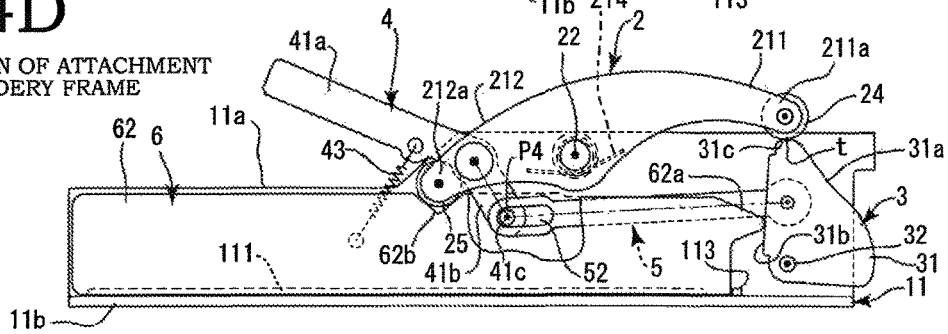
Figure 5A:
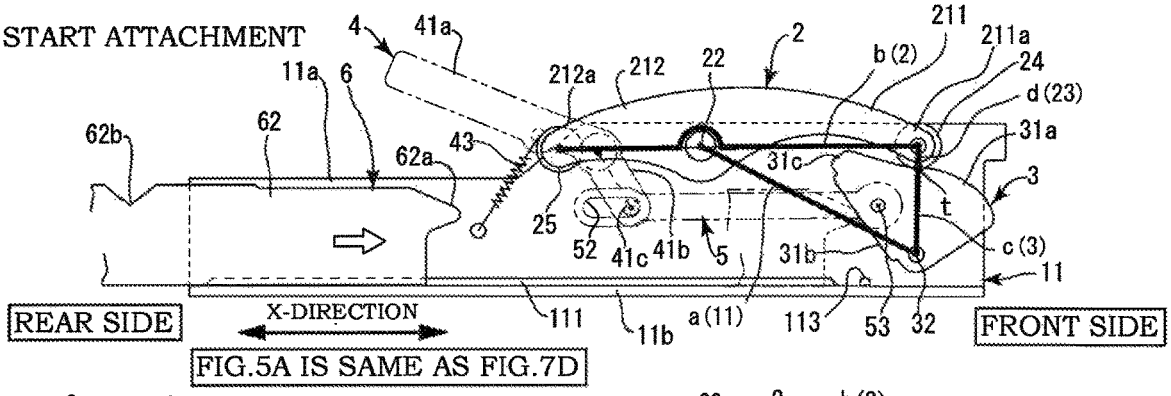
FIGS. 5A to 5D are essential-part step views in which the step from the start of attaching the embroidery frame to the completion of attaching the embroidery frame of the embroidery frame attachment/detachment device in the present invention is replaced with a pseudo quadric link mechanism.
Figure 5B:
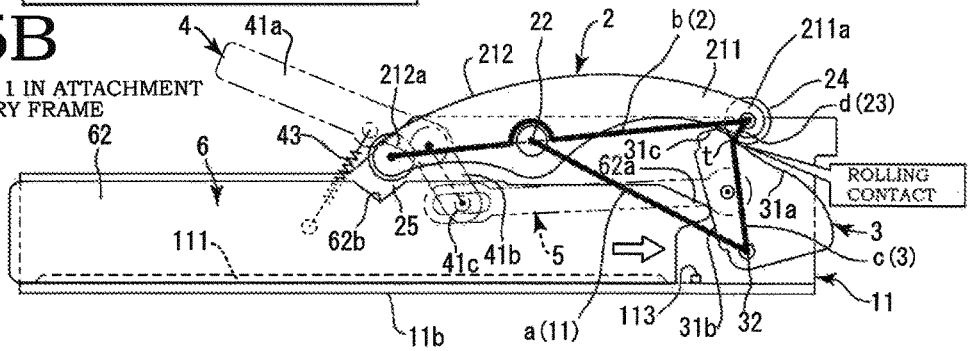
Figure 5C:
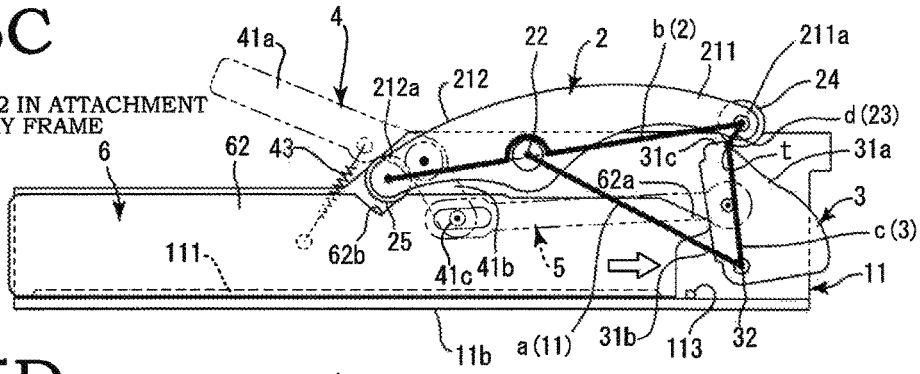
Figure 5D:
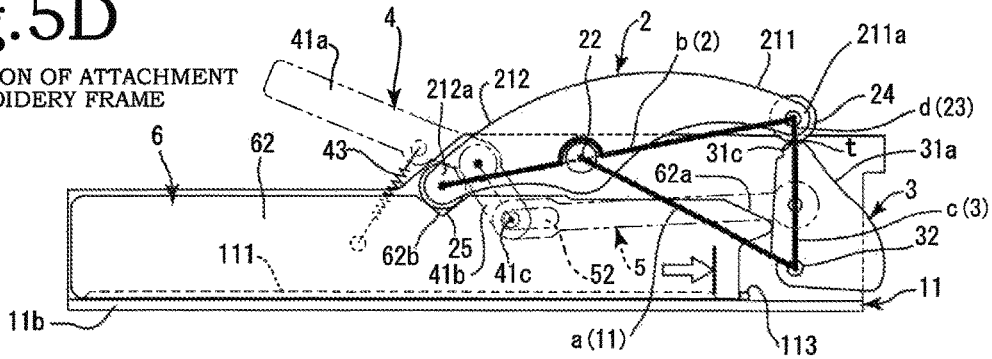

In the cam partial piece portion 31, the cam front surface 31*a* is a gentle arcuate surface, the cam rear surface 31*b* is a flat surface, and the cam top surface 31*c* is a portion placed at the highest position when the embroidery frame 6 is in a locked state in the attachment of the embroidery frame 6 (see FIGS. 4D and 5D). The attachment/detachment cam 3 has a pivotally support hole 3*a* and a coupling hole 3*b*. The attachment/detachment cam 3 is rotatably pivotally supported when an attachment/detachment cam rotating shaft 32*a* provided on the perpendicular base part 11*a* of the base plate 11 is inserted into the pivotally support hole 3*a*, and the pivotally support portion is generically called a pivotally support part 32.

The removing link 4 includes the operating lever part 41*a* and an operating link part 41*b*. The operating lever part 41*a* and the operating link part 41*b* are bent to each other at a prescribed angle and form a substantially "V"-shape (see FIGS. 2A and 3B). The removing link 4 is rotatably pivotally supported by a removing link rotation shaft 42*a* of the base plate 11 at its place near the boundary between the operating lever part 41*a* and the operating link part 41*b*. The pivotally support portion will be called a pivotally support part 42.

The operating link part 41*b* is provided with a coupling pin 41*c* that is coupled to the coupling link 5 that will be described later. Further, a lever knob 44 may be attached to the operating lever part 41*a* (see FIGS. 1B, 2A, and 3A). The lever knob 44 is preferably made of a synthetic resin and formed into a shape easily pinched by a hand.

Figure 3A:
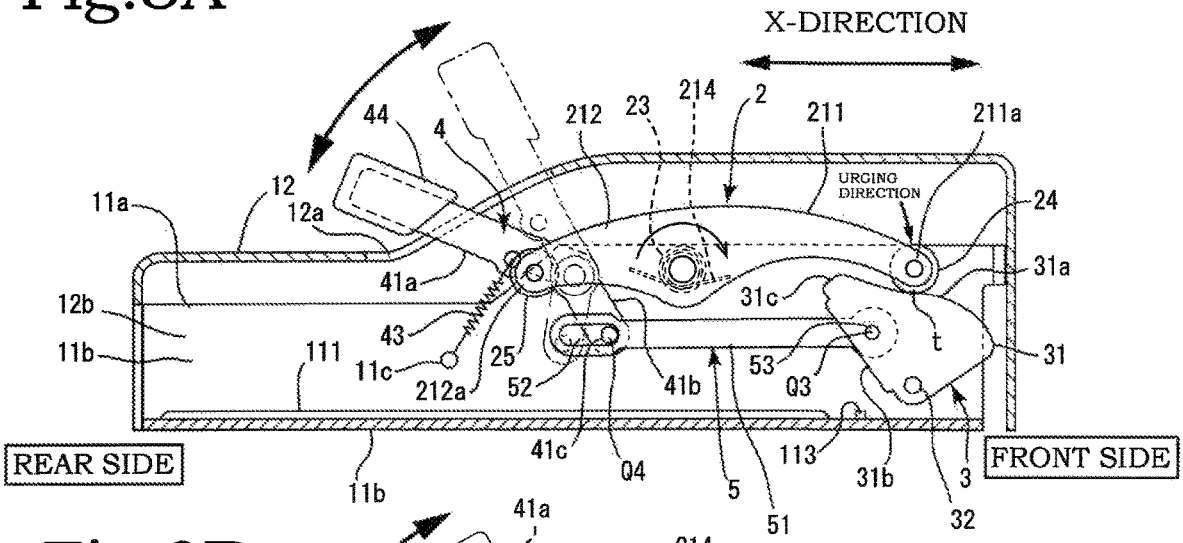
FIG. 3A is a partially cross-sectional view of the essential part of the embroidery frame attachment/detachment device.
Figure 3B:
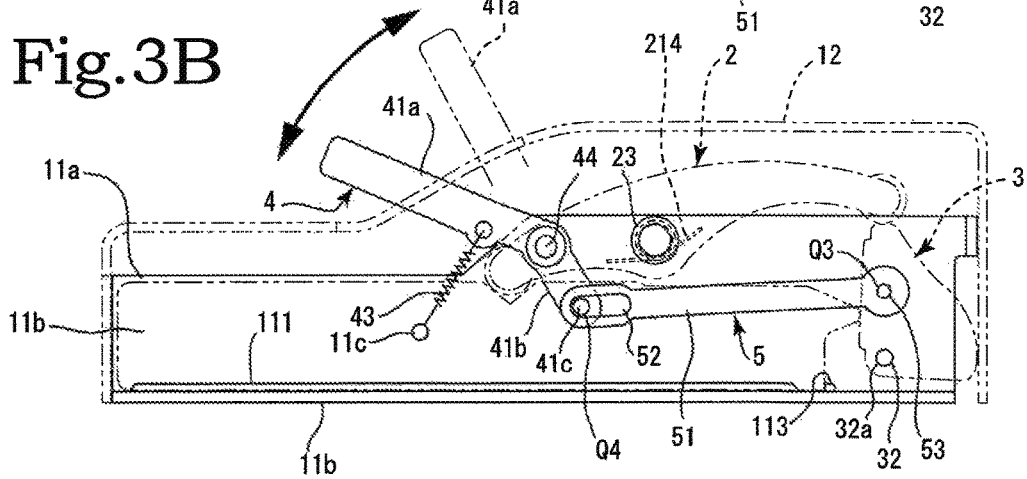
FIG. 3B is a partially cross-sectional view of the essential part in which a part of the embroidery frame attachment/detachment device is omitted.

The removing link 4 is elastically urged by a removing link tensile spring 43 so that the free end side of the operating lever part 41*a* moves downward. As shown in FIGS. 3A and 3B, the removing link 4 is elastically urged counterclockwise. The removing link tensile spring 43 is attached over between the operating lever part 41*a* and a locking part 11*c* provided on the perpendicular base part 11*a* of the base plate 11.

The locking part 11*c* is a pin material or a protruding part formed on the perpendicular base part 11*a*. The operating link part 41*b* of the removing link 4 is coupled to a lateral surface representing the cam partial piece portion 31 of the attachment/detachment cam 3 via the coupling link 5. The coupling link 5 has a long hole part 52 extending in a horizontal direction at one end (on a rear side in the X-direction) of a coupling band part 51, and has a cam coupling pin 53 provided at the other end (on a front side in the X-direction) to be coupled to the attachment/detachment cam 3.

The cam coupling pin 53 of the coupling link 5 is inserted and coupled to the coupling hole 3*b* of the attachment/detachment cam 3. The coupled portion will be called a cam coupling part Q3 (see FIGS. 3A and 3B). The coupling pin 41*c* of the removing link 4 is inserted into the long hole part 52. The coupling portion between the long hole part 52 of the coupling link 5 and the coupling pin 41*c* will be called a removing link coupling part Q4 (see FIGS. 3A and 3B). A rotating operation to release locking is performed on the attachment/detachment cam 3 by the removing link 4 via the coupling link 5.

The fixation arm 2 is formed into an arcuate reverse flat dish shape and includes the two portions of a cam-side arm 211 and a fixation-side arm 212. In FIGS. 3A, 4A to 7D, or the like, the right-side region of the fixation arm 2 serves as the cam-side arm 211, and the left-side region thereof serves as the fixation-side arm 212. In the first embodiment, the fixation arm 2 is a solid object in which the cam-side arm 211 and the fixation-side arm 212 are integrated with each other (see FIG. 2A).

In the fixation arm 2, a substantially center place at the boundary between the cam-side arm 211 and the fixation-side arm 212 serves as a center position for rotation (see FIG. 3A). At the center position, a pivotally support hole 2*a* is formed. The fixation arm 2 is pivotally supported by a shaft provided in the base plate 11. Specifically, the shaft is a fixation arm rotation shaft 22*a*.

The fixation arm 2 is rotatably pivotally supported by the perpendicular base part 11*a* of the base plate 11 when the fixation arm rotation shaft 22*a* is inserted into the pivotally support hole 2*a*. The pivotally support portion will be called a pivotally support part 22 (see FIGS. 2B and 3A). At a place at which the fixation arm 2 is attached in the perpendicular base part 11*a* of the base plate 11, a fixation arm bearing part 23 may be provided. Therefore, the fixation arm rotation shaft 22*a* is easily attached.

In FIG. 3A, the fixation arm 2 is elastically urged clockwise by a spring member 214 with the fixation arm rotation shaft 22*a* of the pivotally support part 22 as a rotation center. The free end of the cam-side arm 211 in the fixation arm 2 is provided with a cam-side contact 211*a*. The cam-side contact 211*a* serves as a portion that contacts (comes in contact with) the attachment/detachment cam 3.

Further, the free end of the fixation-side arm 212 is provided with a fixation-side contact 212*a*, and the fixation-side contact 212*a* serves as a portion that engages a fixation groove 62*b* of the fixation part 62. The cam-side contact 211*a* and the fixation-side contact 212*a* preferably use rollers. A roller provided in the cam-side contact 211*a* will be called a cam roller 24, and a roller provided in the fixation-side contact 212*a* will be called a fixation roller 25. Further, the cam roller 24 and the fixation roller 25 are preferably rollers having the same diameter and the same shape (see FIG. 3A).

Further, as a second embodiment of the present invention, the fixation-side contact 212*a* of the fixation arm 2 does not use the fixation roller 25 but simply has an arcuated tip end (see FIG. 8A). Similarly, in the second embodiment, the cam-side contact 211*a* does not use the cam roller 24 but simply has an arcuated tip end (see FIG. 8B).

Figure 3C:
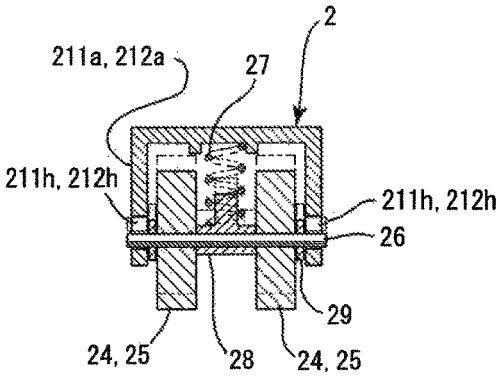
FIG. 3C is a vertically cross-sectional lateral view of the rear contact of a fixation arm.
Figure 3D:
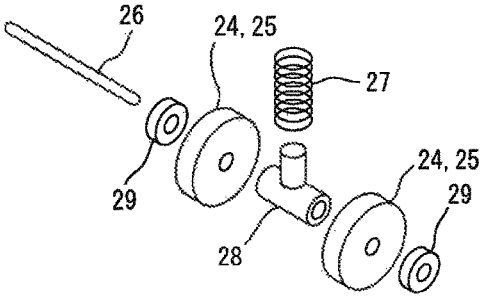
FIG. 3D is an exploded perspective view showing the configuration of the rear contact of the fixation arm.

At least one of the cam roller 24 and the fixation roller 25 may be elastically pressed and supported downward by an urging member 27 while being pivotally supported by a vertically small long hole 211*h* formed on the side of the cam-side contact 211*a* of the fixation arm 2 and a vertically small long hole 212*h* formed on the side of the fixation-side contact 212*a* through a shaft part (roller shaft) 26, a bearing member 28 and a washer 29 so that the cam roller 24 or the fixation roller 25 is vertically movable (see FIGS. 3C and 3D). By such a configuration, the fixation roller 25 is able to engage the fixation groove 62*b* of the fixation part 62 accurately and with a proper pressing force and properly follow the rotating operation of the attachment/detachment cam 3.

Further, the spring member 214 may be attached to the pivotally support part 22 of the fixation arm 2. The cam-side arm 211 may be urged clockwise with respect to the base plate 11 by the spring member 214 and contact (come in contact with) the cam partial piece portion 31 of the attachment/detachment cam 3 with a pressing force (see FIG. 3A).

The fixation-side contact 212*a* of the fixation-side arm 212 contacts the fixation groove 62*b* of the embroidery frame 6 in the attachment of the embroidery frame 6 as will be described later. The embroidery frame attachment/detachment device A is provided with a cover part 12. The cover part 12 has an upper opening 12*a* at its upper part and is attached to the base plate 11 while covering the base plate 11, the fixation arm 2, the attachment/detachment cam 3, the coupling link 5, and a part of the removing link 4.

The operating lever part 41*a* of the removing link 4 and the lever knob 44 are exposed to the outside of the cover part 12 from the upper opening 12*a*. The removing link 4 is operable from the outside of the cover part 12. Further, the cover part 12 has, at its lower part, a lower opening 12*b* where an outer frame part 61 of the embroidery frame 6 that will be described later enters/exits and is slidable. The lower opening 12*b* is provided in a range in which the embroidery frame 6 slides when attached to the base plate 11.

The embroidery frame 6 includes the outer frame part 61, an outer frame fastening/loosening part 611, the fixation part 62, and an inner frame part 63 (see FIG. 1C). The inner frame part 63 is attachable to and detachable from the outer frame part 61. The fixation of cloth is performed in such a manner that the cloth is held between the inner frame part 63 and the outer frame part 61 and the cloth and the inner frame are fastened with a reduction in the inner diameter of the outer frame part 61 by the outer frame fastening/loosening part 611. Then, the embroidery frame 6 is fixed to the embroidery frame attachment/detachment device A by the fixation part 62. The fixation part 62 is provided with a pressing part 62*a*, the fixation groove 62*b*, and a recessed rail part 62*c* (see FIG. 1C).

The fixation part 62 is formed into a substantially cuboid housing shape and provided with the pressing part 62*a* on its front side in the X-direction. The pressing part 62*a* has a substantially triangular shape when seen from its front side and has a surface inclined downward toward the front side in the X-direction as its upper surface (see FIGS. 1C, 2A to 7D, or the like).

The fixation groove 62*b* is formed on the upper surface of the fixation part 62 and at a substantially intermediate position in the X-direction. The fixation groove 62*b* has a substantially flat "V"-shape or an inverted triangle mountain shape (see FIGS. 1C, 4A to 7D, or the like). Further, the fixation groove 62*b* may be a substantially semi-circular or "U"-shaped groove. The recessed rail part 62*c* is provided at the lower end of the fixation part 62.

Next, the attachment step of attaching the embroidery frame 6 to the base plate 11 in the embroidery frame attachment/detachment device A will be described on the basis of FIGS. 4A to 6D. When the fixation part 62 of the embroidery frame 6 is attached to the base plate 11 in the attachment step of attaching the embroidery frame 6, the embroidery frame 6 is positioned on the rear side in the X-direction of the base plate 11 and slid forward so that the protruding rail part 111 of the embroidery frame attachment/detachment device A is fitted into the recessed rail part 62*c* of the embroidery frame 6 (see FIG. 4A).

When the sliding of the fixation part 62 of the embroidery frame 6 is continued, the pressing part 62*a* positioned on the front side of the embroidery frame 6 contacts the cam rear surface 31*b* of the attachment/detachment cam 3 (see FIG. 4B). When the sliding of the fixation part 62 is further continued, the pressing part 62*a* acts so as to press the cam rear surface 31*b* of the attachment/detachment cam 3 and push over the attachment/detachment cam 3 in a clockwise direction (see FIG. 4C) to place the cam top surface 31*c* of the attachment/detachment cam 3 at the highest position (see FIG. 4D). As a result, the cam-side contact 211*a* of the fixation arm 2 moves upward.

As the cam-side contact 211*a* of the fixation arm 2 moves upward, the fixation arm 2 rotates counterclockwise and the fixation-side contact 212*a* engages the fixation groove 62*b* of the fixation part 62. In this manner, the embroidery frame 6 is fixed in a front-rear direction and a vertical direction. On the other hand, the embroidery frame 6 is also fixed in a horizontal direction since the protruding rail part 111 of the base plate 11 engages the recessed rail part 62*c* of the embroidery frame 6. Accordingly, the attachment of the embroidery frame 6 is completed (see FIG. 4D).

FIGS. 5A to 5D are explanatory views in which the fixation arm 2, the attachment/detachment cam 3, the removing link 4, and the coupling link 5 are assumed as a pseudo quadric link mechanism in the attachment step. First, a line segment connecting the pivotally support part 22 of the fixation arm 2 and the pivotally support part 32 of the attachment/detachment cam 3 to each other is assumed as a link a, a line segment connecting the cam-side contact 211*a* and the fixation-side contact 212*a* of the fixation arm 2 to each other is assumed as a link b, a line segment connecting the pivotally support part 32 of the attachment/detachment cam 3 and a contact point t contacting the cam-side contact 211*a* to each other is assumed as a link c, and a line segment connecting the cam-side contact 211*a* of the fixation arm 2 and the contact point t contacting the attachment/detachment cam 3 to each other is assumed as a link d.

A pseudo quadric link is constituted by the links a, b, c, and d. In the attachment step, the embroidery frame 6 is attached to the embroidery frame attachment/detachment device A of the X-Y driving unit 1 by the fixation part 62 of the embroidery frame 6, the fixation arm 2, and the attachment/detachment cam 3. Note that FIGS. 5A to 5D and FIGS. 7A to 7D that will be described later are views in which the present embodiment including a cam mechanism is regarded as a link mechanism for explanation. The link mechanism does not imply a strict link mechanism or may not be necessarily provided.

Note that the links c and d are arranged in a straight line (including a substantially straight line) in the attachment state of the embroidery frame 6 as shown in FIG. 5D. Therefore, the repulsive force of a force generated when the fixation-side contact 212*a* presses the fixation groove 62*b* acts on the cam-side contact 211*a*, and a force in a rotating direction does not act on the attachment/detachment cam 3 even if the cam-side contact 211*a* presses the cam top surface 31*c* downward. Accordingly, in the attachment state of FIG. 5D, a state in which the fixation-side contact 212*a* presses the fixation groove 62*b* is maintained, and the embroidery frame 6 is firmly fixed in the front-rear direction and the vertical direction.

Next, the detachment step of detaching the embroidery frame 6 from the base plate 11 will be described on the basis of FIGS. 6A to 6D. In order to remove the embroidery frame 6 from the base plate 11 of the embroidery frame attachment/detachment device A, the removing link 4 is operated. As described above, the removing link 4 is coupled to the attachment/detachment cam 3 via the coupling link 5. When the removing link 4 is operated clockwise, the attachment/detachment cam 3 rotates counterclockwise (see FIGS. 6A and 6B). At the same time, the engagement between the fixation-side contact 212*a* and the fixation groove 62*b* is released and the fixation of the embroidery frame 6 in the front-rear direction and the vertical direction is released when the fixation arm 2 rotates clockwise with the action of the cam front surface 31*a* of the attachment/detachment cam 3 (see FIG. 6C).

Figure 6A:
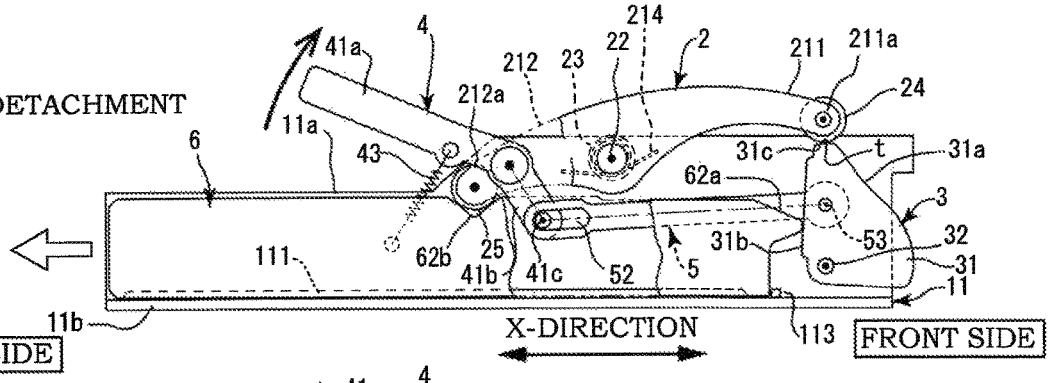
FIGS. 6A to 6D are partially-cut essential-part step views showing a step from the start of detaching the embroidery frame to the completion of detaching the embroidery frame of the embroidery frame attachment/detachment device in the present invention.
Figure 6B:
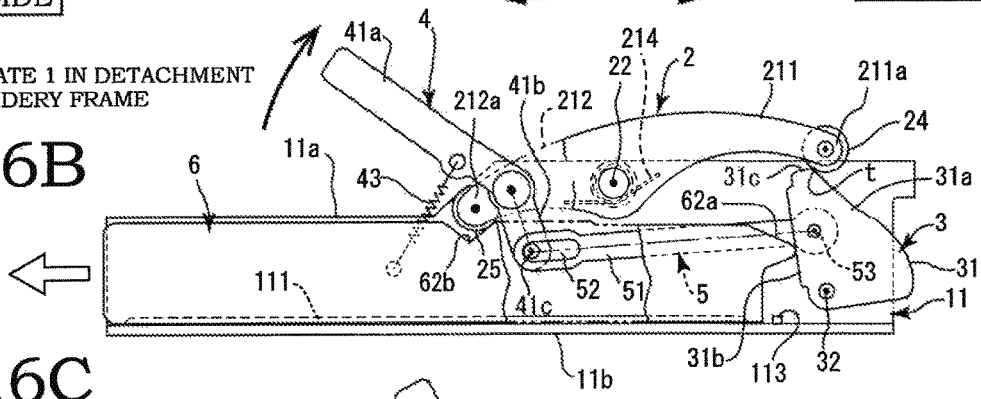
Figure 6C:
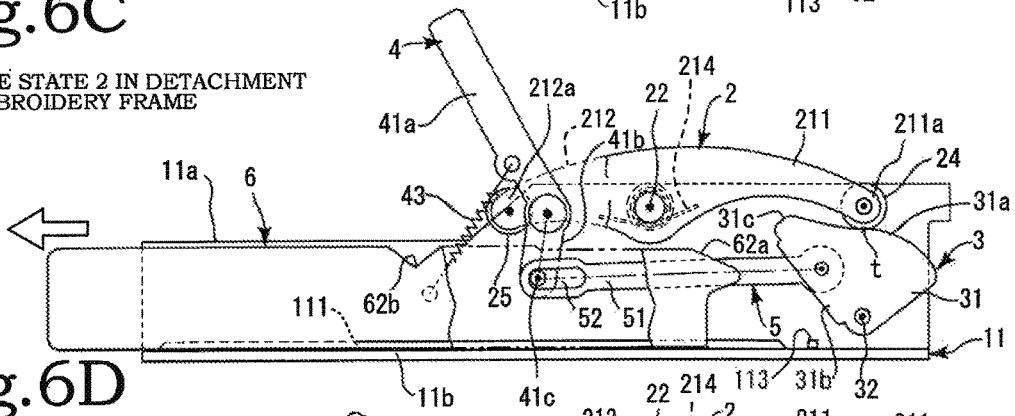

Even if the operation of the removing link 4 is completed (a hand is released from the removing link 4) in a state in which the fixation of the embroidery frame 6 is released in the front-rear direction and the vertical direction as shown in FIG. 6C, a state in which the fixation of the embroidery frame 6 is released in the front-rear direction and the vertical direction is maintained.

Figure 6D:
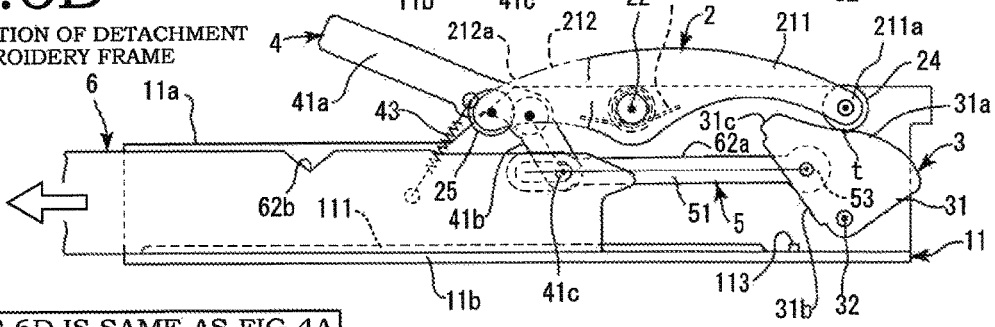
Figure 7A:
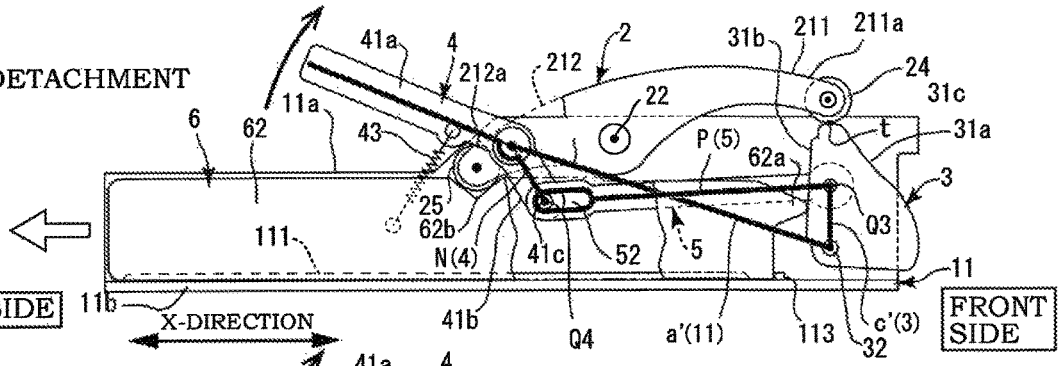
FIGS. 7A to 7D are essential-part step views in which the step from the start of detaching the embroidery frame to the completion of detaching the embroidery frame of the embroidery frame attachment/detachment device in the present invention is replaced with the pseudo quadric link mechanism.
Figure 7B:
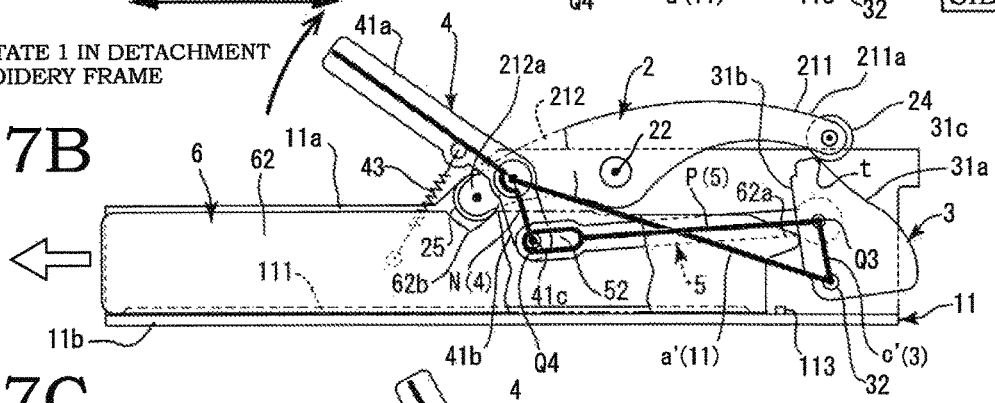
Figure 7C:
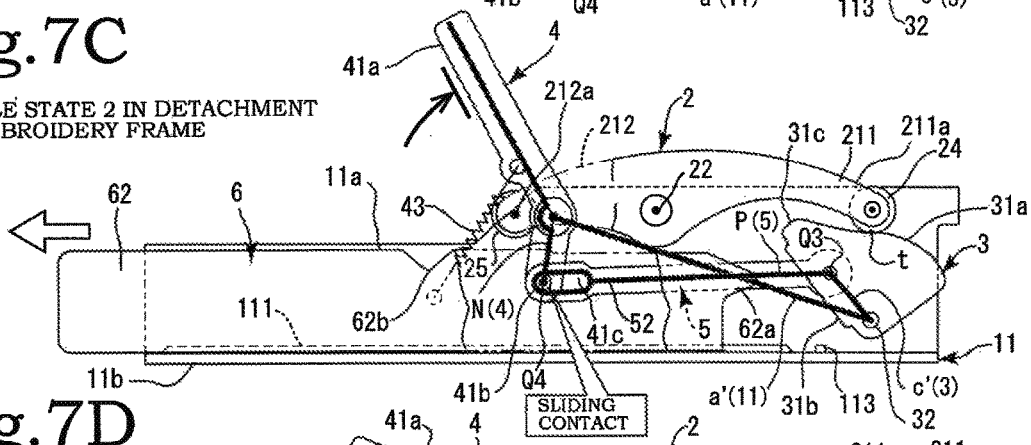
Figure 7D:
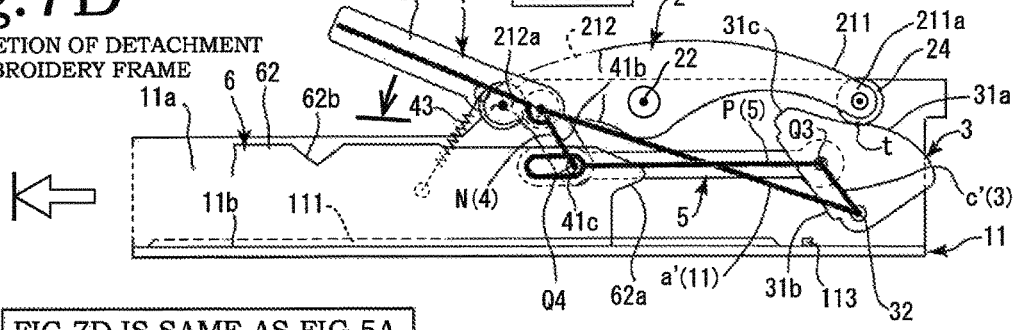

Accordingly, an operator completes the operation of the link 4 and then slides the embroidery frame 6 in the rear direction (see FIG. 6D). Through the above operation, it is possible to more easily remove an embroidery frame.

FIGS. 7A to 7D are explanatory views in which the fixation arm 2, the attachment/detachment cam 3, the removing link 4, and the coupling link 5 are assumed as a pseudo quadric link mechanism in the detachment step. First, a line segment connecting the pivotally support part 42 of the removing link 4 and the pivotally support part 32 of the attachment/detachment cam 3 to each other is assumed as a link P, a line segment connecting the pivotally support part 32 of the attachment/detachment cam 3 and a coupling part Q3 between the attachment/detachment cam 3 and a coupling part Q3 of the coupling link 5 to each other is assumed as a link c', a line segment connecting the coupling part Q3 between the coupling link 5 and the attachment/detachment cam 3 and a coupling part Q4 between the removing link 4 and the long hole part 52 of the coupling link 5 to each other is assumed as a link P, and a line segment connecting the pivotally support part 42 of the removing link 4, and the coupling part Q4 between the removing link 4 and the long hole part 52 of the coupling link 5 to each other is assumed as a link N.

A pseudo quadric link is constituted by the links a', c', N, and P. In the detachment step, the embroidery frame 6 is detached from the embroidery frame attachment/detachment device A of the X-Y driving unit 1 by the fixation part 62 of the embroidery frame 6, the fixation arm 2, and the attachment/detachment cam 3.

Figure 9A:
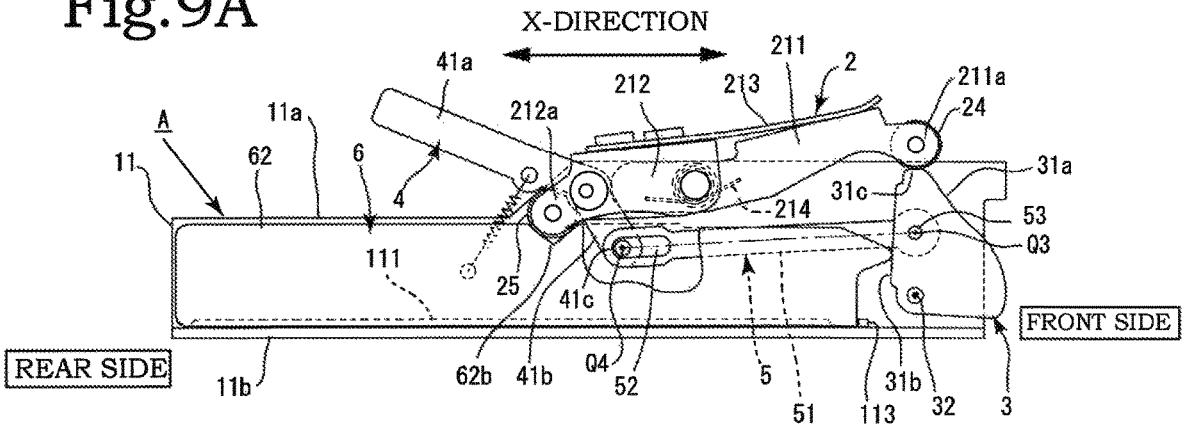
FIG. 9A is a front view of the partially-omitted embroidery frame attachment/detachment device showing a third embodiment of the present invention.
Figure 9B:
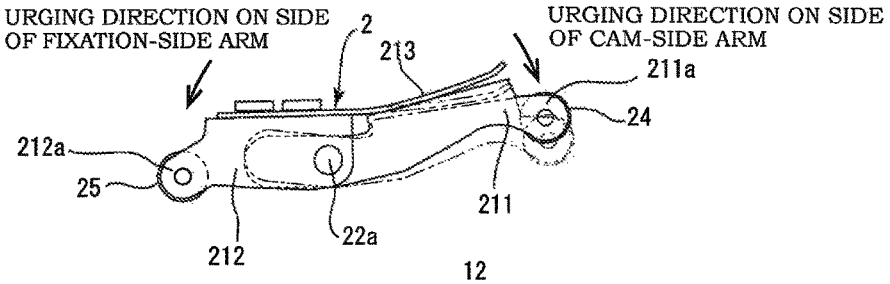
FIG. 9B is a front view of the fixation arm in the third embodiment.
Figure 9C:
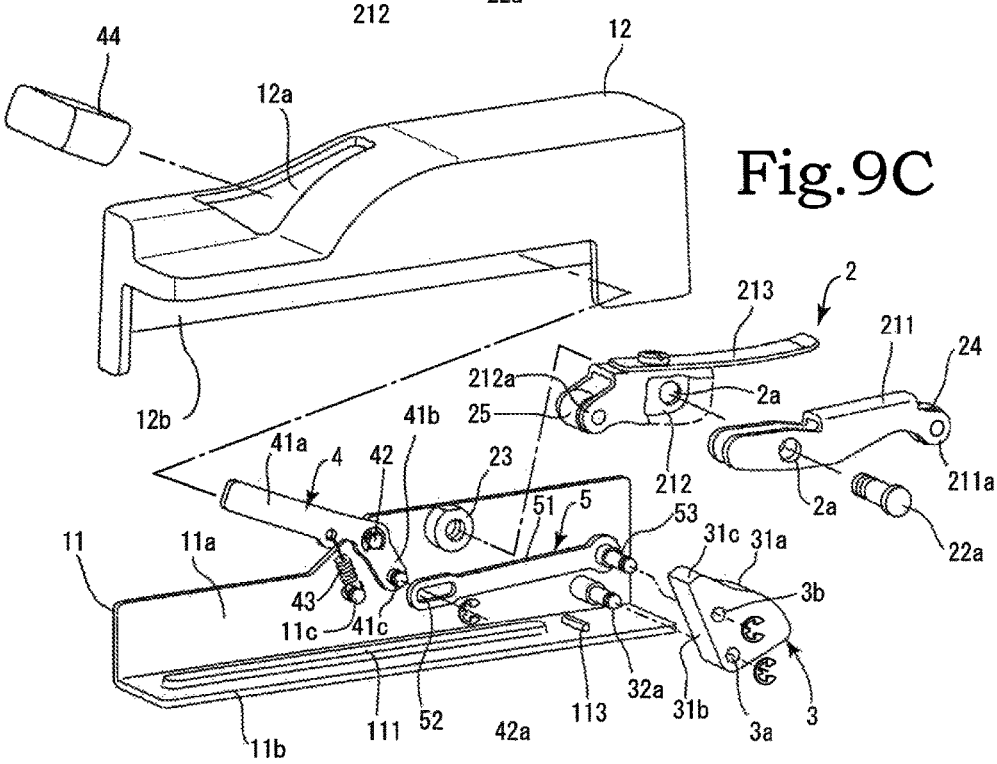
FIG. 9C is an exploded perspective view of the embroidery frame attachment/detachment device in the third embodiment.
Figure 10A:
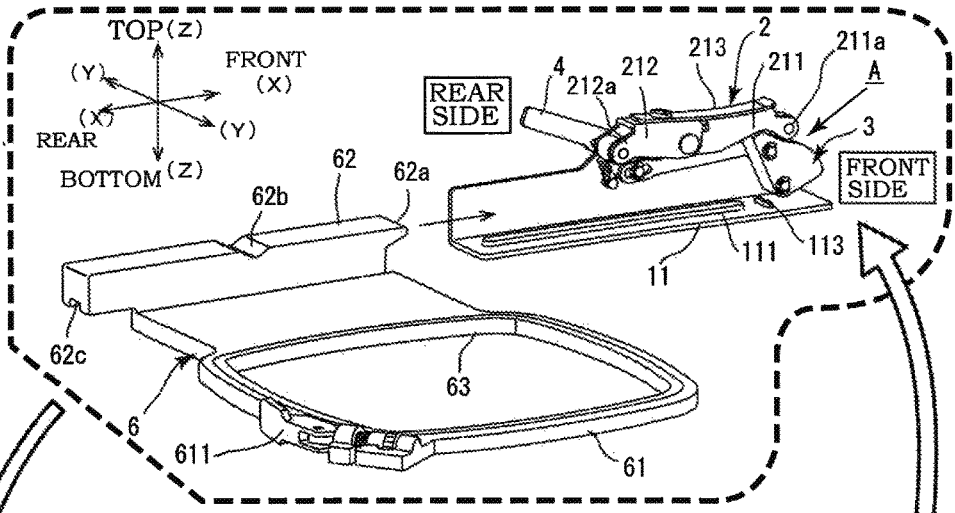
FIGS. 10A to 10D are perspective views showing the detachment step of the third embodiment in the present invention.
Figure 10B:
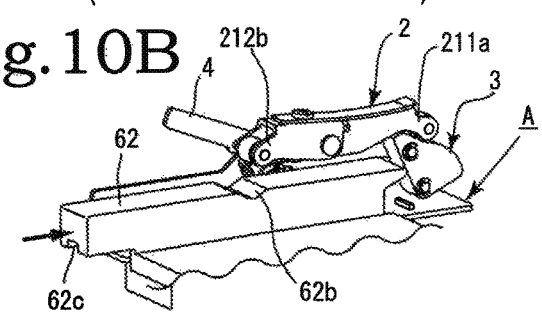
Figure 10D:
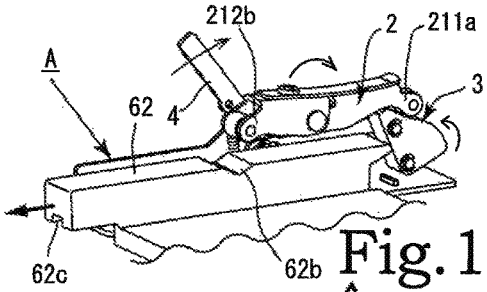
Figure 10C:
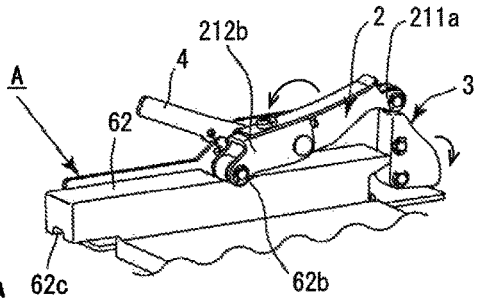

FIGS. 9A to 9C show a third embodiment of the present invention. In the third embodiment, the two portions of the cam-side arm 211 and the fixation-side arm 212 are separately attached and mutually rotatable. Further, an elastic member 213 is attached to any one of the cam-side arm 211 and the fixation-side arm 212, and the free end side of any one of the cam-side arm 211 and the fixation-side arm 212 is elastically urged downward (see FIG. 9B).

Specifically, a plate spring is preferably used as the elastic member 213 (see FIGS. 9A to 9C). The cam-side arm 211 and the fixation-side arm 212 are pivotally supported by a fixation arm rotation shaft 22*a* so as to be mutually rotatable. The cam-side arm 211 and the fixation-side arm 212 substantially integrated with each other so as to have flexibility and rotatably attached to the base plate 11. The fixation-side arm 212 is elastically urged counterclockwise with respect to the cam-side arm 211 clockwise via the elastic member 213 (see FIG. 9B).

On the other hand, the cam-side arm 211 and the fixation-side arm 212 are urged clockwise with respect to a base plate 11 by a spring member 214 in FIG. 9A. However, the spring force of the spring member 214 is substantially smaller than that of the elastic member 213. However, when the embroidery frame 6 is not attached, the cam-side contact 211*a* stops at a position at which the cam-side contact 211*a* contacts the cam front surface 31*a* of the attachment/detachment cam 3 in a state in which the cam-side arm 211 and the fixation-side arm 212 are integrated with each other.

In FIG. 9C, reference symbol 23 represents a fixation arm bearing part for pivotally supporting the fixation arm 2 that is provided on the perpendicular base part 11*a* of the base plate 11. Further, the pivotally support holes 2*a* are formed on both the cam-side arm 211 and the fixation-side arm 212, and the cam-side arm 211 and the fixation-side arm 212 are coupled to each other so as to be mutually rotatable by the shaft (fixation arm rotation shaft 22*a*) (see FIG. 9C).

FIGS. 10A to 10D show the cycle of the attachment step and the detachment step of the embroidery frame attachment/detachment device A in the third embodiment. As shown in FIGS. 10A to 10D, the positional relationship (angle) between the cam-side arm 211 and the fixation-side arm 212 changes due to the deformation of the elastic member 213 when the embroidery frame 6 is attached, whereby respective members are allowed to absorb rattling or dimensional fluctuations in the third embodiment. In the embroidery frame attachment/detachment device A using the fixation arm 2 in the third embodiment, the attachment step and the detachment step are substantially the same as those of the embroidery frame attachment/detachment device A in the first embodiment and thus their detailed descriptions will be omitted.

As described above, it is possible to easily perform the operation of attaching/detaching the embroidery frame 6 to/from the embroidery frame attachment/detachment device A and generate a large retention force with a light operating force since the cam and the links are employed in the main fixation mechanism. However, in the present embodiment, the fixation-side contact 212*a* retains the fixation groove 62*b* with an elastic urging force generated by the elastic member 213 but the elastic member 213 aims to correspond to rattling or dimensional fluctuations as described above. Therefore, the elastic member 213 may not be provided.

Further, a stopper 113 is provided in the embroidery frame attachment/detachment device A, and excessive pressing of the embroidery frame 6 is suppressed by the stopper 113. However, in the present embodiment, the stopper 113 may not be provided since the engagement between the fixation-side contact 212*a* and the fixation groove 62*b* restricts movement in the front-rear direction of the embroidery frame 6 and suppresses excessive pressing. Further, the "clockwise" and "counterclockwise" directions described above are directions when seen from a prescribed side. When seen from the side opposite to the prescribed side, the "clockwise" direction can be a "counterclockwise" direction and the "counterclockwise" direction can be a "clockwise" direction.

In the second embodiment, the fixation arm includes the fixation roller that presses and fixes the fixation groove at the one end thereof and the cam roller that contacts the attachment/detachment cam at the other end. In the third embodiment, the fixation roller elastically presses and fixes the fixation groove of the fixation part. Thus, when the embroidery frame is slid to be attached to the base plate, the pressing part of the fixation part contacts the fixation roller of the fixation arm. However, the fixation roller is allowed to smoothly follow the pressing part that moves along an attachment direction.

Moreover, when the pressing part presses the attachment/detachment cam, the cam roller of the fixation arm contacts the rotating attachment/detachment cam. As a result, the cam roller is allowed to extremely smoothly follow the rotation of the attachment/detachment cam. Thus, the fixation arm smoothly operates, and the fixation roller is allowed to smoothly enter the fixation groove of the fixation part of the embroidery frame. As a result, it possible to extremely smoothly perform the operation of attaching/detaching the embroidery frame to/from the base plate.

In the fourth embodiment, the shaft part of at least one of the fixation roller and the cam roller is elastically pressed and supported downward by the urging member while being pivotally supported by the vertically small long hole. Thus, the cam roller is allowed to contact the attachment/detachment cam with elasticity at all times. Further, the fixation roller is allowed to contact the fixation groove of the fixation part of the embroidery frame with pressure having elasticity at all times. Thus, it is possible to make a fixation state firm when the fixation part of the embroidery frame is attached to the base plate and robustly respond to vibrations or the like from a sewing machine in an embroidery sewing operation.

In the fifth embodiment, the fixation arm further includes the cam-side arm, the fixation-side arm, and the elastic member connecting the cam-side arm and the fixation-side arm to each other, and the cam-side arm and the fixation-side arm are pivotally supported by the shaft. Thus, it is possible to make the cam-side arm and the fixation-side arm reliably contact the attachment/detachment cam and the fixation groove of the embroidery frame, respectively, at all times with the elastic member and secure the attachment state of the embroidery frame with respect to the base plate.

In the sixth embodiment, the link end on the one end side of the removing link is slidably supported by the long hole formed at the end of the coupling link. Thus, in the step of attaching the fixation part of the embroidery frame to the base plate, the fixation part is in an immovable state, placed at a constant position at all times, does not move unnecessarily, and silently attachable in operation.

In the seventh embodiment, the recessed rail part formed on the fixation part of the embroidery frame is slidable against the protruding rail part provided on the flat part surface of the base plate. Thus, when sliding in the attachment operation of the embroidery frame, the fixation part is allowed to stably move with respect to the base plate.

In the eighth embodiment, it is possible to achieve a sewing machine suitable for embroidery sewing with the provision of the embroidery frame attachment/detachment device.

What is claimed is:

1. An embroidery frame driving device to and from which an embroidery frame is attachable and detachable, the embroidery frame driving device comprising:

a base plate that is firmly fixed to an X-Y driving unit of the embroidery frame driving device;

a fixation arm that is pivotally supported by a shaft provided in the base plate;

a substantially triangular attachment/detachment cam that is pivotally supported by the base plate;

a removing link that is pivotally supported by the base plate; and a coupling link that couples one end of the removing link and a cam partial piece portion of the attachment/detachment cam to each other, wherein the embroidery frame includes a fixation groove that is pressed and fixed by one end of the fixation arm and a fixation part having a pressing part formed at a tip thereof, the embroidery frame is slid against the base plate to rotate the attachment/detachment cam through pressing of the pressing part of the fixation part to rotate the fixation arm via the other end of the fixation arm and press and fix the one end of the fixation arm to the fixation groove of the fixation part in attachment of the embroidery frame, and the removing link is operated to rotate the attachment/detachment cam via the coupling link and the cam partial piece portion to rotate the fixation arm and release pressing and fixation of the fixation groove of the fixation part by the one end of the fixation arm in detachment of the embroidery frame.

2. The embroidery frame attachment/detachment device according to claim 1, wherein the fixation arm includes a fixation roller that presses and fixes the fixation groove at the one end thereof and a cam roller that contacts the attachment/detachment cam at the other end thereof.

3. The embroidery frame attachment/detachment device according to claim 2, wherein the fixation roller elastically presses and fixes the fixation groove of the fixation part.

4. The embroidery frame attachment/detachment device according to claim 2, wherein a shaft part of at least one of the fixation roller and the cam roller is elastically pressed and supported downward by an urging member while being pivotally supported by a vertically small long hole.

5. The embroidery frame attachment/detachment device according to claim 1, wherein the fixation arm further includes a cam-side arm, a fixation-side arm, and an elastic member that connects the cam-side arm and the fixation-side arm to each other, and the cam-side arm and the fixation-side arm are pivotally supported by the shaft.

6. The embroidery frame attachment/detachment device according to claim 1, wherein a link end on the one end side of the removing link is slidably supported by a long hole formed at an end of the coupling link.

7. The embroidery frame attachment/detachment device according to claim 1, wherein a recessed rail part formed on the fixation part of the embroidery frame is slidable on a protruding rail part provided on a flat part surface of the base plate.

8. An embroidery sewing machine including the embroidery frame attachment/detachment device according to claim 1.

* * * * *